United States Patent [19]

Vargo, Jr. et al.

[11] 4,060,189

[45] Nov. 29, 1977

[54] SLUG RIVETING APPARATUS

[75] Inventors: Joseph Vargo, Jr., West Seneca; John W. Davern, North Tonawanda, both of N.Y.

[73] Assignee: General-Electro Mechanical Corporation, Buffalo, N.Y.

[21] Appl. No.: 735,388

[22] Filed: Oct. 26, 1976

[51] Int. Cl.[2] ..... B21J 15/36

[52] U.S. Cl. ..... 227/53; 227/62; 227/149

[58] Field of Search ..... 227/51, 52, 53, 61, 227/62, 149

[56] References Cited

U.S. PATENT DOCUMENTS

| | | | |
|---|---|---|---|
| 3,491,930 | 1/1970 | Hill | 227/62 |
| 3,557,442 | 1/1971 | Speller | 227/26 |
| 3,668,760 | 6/1972 | Biederman et al. | 227/149 |
| 3,816,895 | 6/1974 | Kuehn et al. | 227/149 |
| 3,847,193 | 11/1974 | Brunstetter | 227/147 |

*Primary Examiner*—Granville Y. Custer, Jr.
*Attorney, Agent, or Firm*—Christel & Bean

[57] ABSTRACT

The invention relates to slug riveting apparatus wherein a pair of opposed rivet head forming anvils move relatively toward each other to form heads at the opposite ends of a cylindrical rivet blank, more or less simultaneously, after the blank has been inserted in the workpieces. An annular elastomeric polyurethane member is associated coaxially with one of the rivet head forming anvils and has a bore for receiving and resiliently gripping a cylindrical rivet blank. The elastomeric annular member holds the blank during insertion of the blank in the workpieces as the anvils move relatively toward each other, and the rivet blank is moved out of engagement with the elastomeric annular member by the associated head forming anvil during the head forming operation by resilient radial expansion of the elastomeric annular member. The rivet forming anvils have flat bottomed head forming recesses with sloping side walls. The flat bottoms of the recesses are of substantially the same diameter as the ends of the rivet blanks or slugs to retain the latter in an accurately centered coaxial position with respect to the head forming anvils throughout the slug insertion and the head forming operations.

9 Claims, 4 Drawing Figures

SLUG RIVETING APPARATUS

BACKGROUND OF THE INVENTION

This invention relates to riveting devices and more particularly to devices for effecting what is known in the art as slug riveting.

In slug riveting the blank rivets are plain cylindrical members which are inserted in workpieces and both ends of the slug are upset after such insertion to form rivet heads at opposite sides of the workpieces. In prior art apparatus of this general class a substantial problem has existed in effectively feeding rivet blanks or slugs to the riveting mechanism and in inserting the blanks in the rivet holes of the workpieces.

The achievement of these objects in prior art slug riveting apparatus is further complicated by the necessity for accurately controlling the axial position of the rivet blank or slug so that the slug projects the proper distance from the work at opposite sides thereof at all stages of the inserting and head forming operations. This latter necessity must be met so that the proper amount of blank material is present at opposite sides of the work to properly form heads at the opposite sides of the work.

A further problem in prior art slug riveting has been the difficulty of maintaining the rivet slug in an accurately aligned position coaxial with the rivet head forming anvils.

SUMMARY OF THE INVENTION

The present invention provides an annular elastomeric member in combination with the riveting means at one side of the workpieces for receiving a rivet blank or slug and for releasably holding the same during insertion into the workpieces and until head formation has begun. The slug is initially resiliently held in an opening in the elastomeric member which is concentric with the rivet forming anvils and is adjacent to one of them and the member is so formed that the rivet-holding opening therein is expanded by the associated rivet head forming anvil as the latter moves toward the work in a head-forming operation.

In the apparatus of the present invention the opposed rivet head forming anvils have head forming recesses therein which have flat bottoms of the same diameter as the ends of the slug or blank and have sloping side walls so that the ends of the slug are guided to seat against the flat bottoms of the recesses and are thus retained in an accurately aligned coaxial position with respect to the rivet head forming anvils.

DESCRIPTION OF THE ILLUSTRATED EMBODIMENT

Figure 1:
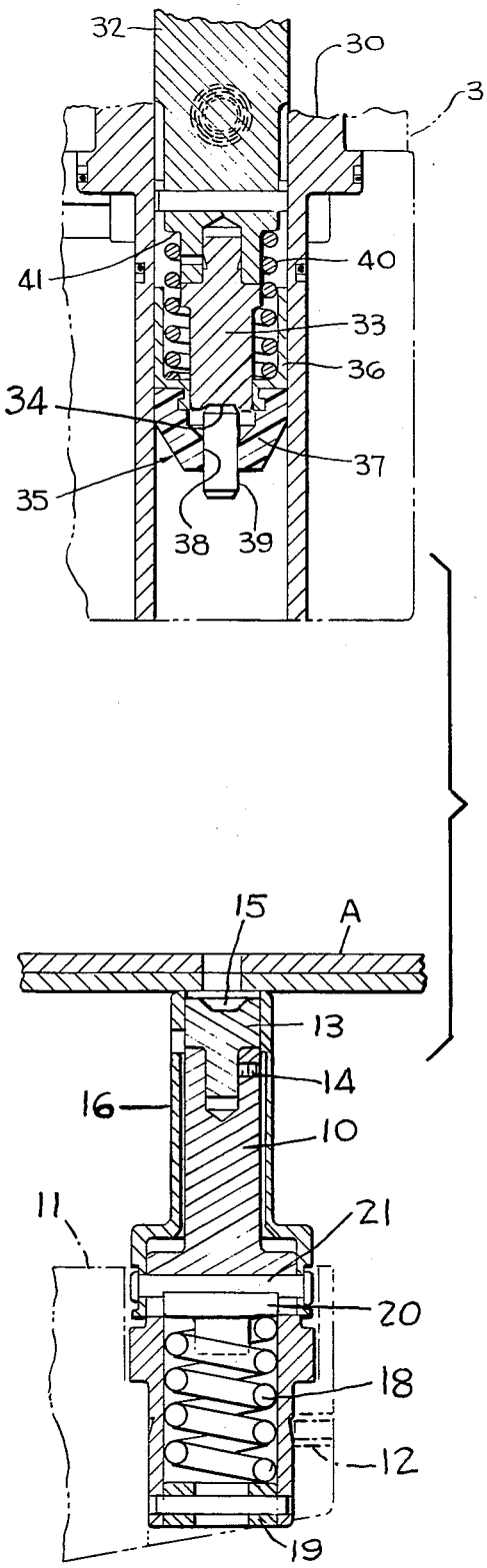
FIGS. 1 through 4 are similar views taken on a plane extending along the axis of the riveting apparatus and showing successive positions of the parts as the rivet blank insertion and head forming operation proceeds.

In the drawings the numeral 10 designates a lower anvil support which is removably fixed to the lower leg 11 of a C-frame member of the riveting apparatus by a setscrew 12 or the like and has a rivet head forming anvil 13 at its upper end which is removably retained by a setscrew 14. This much of the anvil support structure is fixed and immovable during riveting operations. A rivet head forming recess at the upper end of lower anvil 13 is designated 15 and has a flat circular bottom wall and a sloping frusto-conical side wall.

A workpiece clamping sleeve 16 telescopes over the upper end of lower anvil support 10 and is vertically slidable thereon. The lower end of anvil support 10 is hollow and receives a compression coil spring 18 which seats upon a plug 19. A pressure pad 20 seats upon the upper end of coil spring 18 and a cross pin 21 which bears in the lower end of clamp sleeve 16 rests in a semi-circular groove in the top of pressure pad 20. Thus the coil spring 18 urges the clamp sleeve 16 resiliently upwardly with respect to the anvil support 10. In FIG. 1 the clamp sleeve 16 is in its upper limit position with respect to anvil support 10.

Referring now to the upper riveting mechanism, a bearing 30 is fixed to or forms a part of the upper leg 31 of the C-frame member mentioned above. A C-frame is mentioned here merely by way of example and actually the upper and lower riveting mechanisms may be supported in any desired manner. A ram element 32 is slidable vertically in bearing 30 and connects at its upper end with power means (not shown) which reciprocates ram 32 vertically to effect rivet head forming strokes. A rivet head forming anvil 33 is secured to the lower end of ram 32 as clearly shown in FIG. 1. The lower face of anvil 33 has a head forming recess 34 which duplicates the head forming recess 15 of lower anvil 13, having a flat bottom and a frusto-conical side wall. Thus the chamfered ends of a rivet slug 39 seat in the recess with its reduced diameter end faces seated flat against the bottom walls of the head forming recesses 15 and 34 by which means the slug is accurately centered and is retained in a coaxial position with respect to the upper and lower head forming means.

A combined spring pad and slug receiving and retaining member designated generally by the reference numeral 35 is likewise vertically slidable in bearing 30 and comprises a sleeve 36 and an elastomeric slug retainer 37 of polyurethane or similar material. It will be noted that the lower end of sleeve 36 and the upper end of elastomeric slug retainer 37 are mutually formed so that the latter may be stretched over the bottom flange of the sleeve 36 and thus snapped into secure assembly with the sleeve.

The lower end of slug retainer 37 is frusto-conical and has an opening 38 for receiving and resiliently gripping a rivet blank or slug 39. The mechanism for inserting successive slugs in the retainer 37 is shown and described in a companion patent application of Dario Anselmo Ser. No. 735,389 filed Oct. 26, 1976.

It will be noted that the interior opening of retainer 37, from the upper end of opening 38, flares outwardly to a diameter which receives the lower end of rivet head forming anvil 33. A compression coil spring 40 seats at its lower end in sleeve 36 and bears at its upper end against an external ledge 41 on rod 32. Spring 40 urges the slug receiving and retaining member 35 resiliently downwardly relative to rod 32 and anvil 33.

Figure 2:
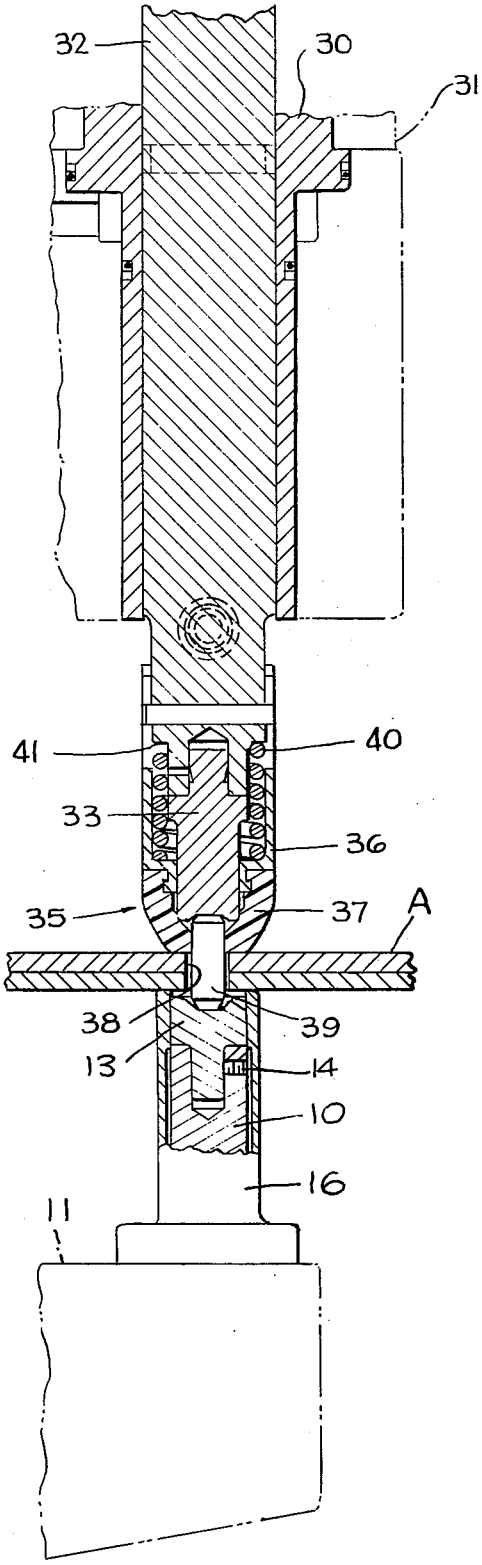

Beginning with the parts in the position shown in FIG. 1 and with a rivet slug 39 inserted in the elastomeric member 37, the ram is forcibly projected downwardly by the aforesaid hydraulic operating means until the slug 39 is inserted in the holes in workpieces A with its lower end seated centrally in the recess 15 of the lower rivet head forming anvil 13 as illustrated in FIG. 2. During the latter part of this downward movement the coil spring 40 is compressed somewhat whereby the elastomeric member 37 is resiliently pressed against the surface of the top workpiece and the workpieces A are, accordingly, gripped between the top end of clamping sleeve 16 and the lower surface of elastomeric member 37.

In the final portion of the slug inserting movement which brings the parts to the position illustrated in FIG. 2. the upper head forming anvil 33 begins to move downwardly into the flared opening portion which extends downwardly to the rivet gripping opening 38 of the elastomeric member 37. Further downward movement of ram 32 and its associated head forming anvil 33 brings the coiled of spring 40 to a substantially bottomed condition and, accordingly, movement of the parts from the position of FIG. 2 to that of FIG. 3 results in a spreading of the lower end of elastomeric member 37 radially outwardly by reason of the movement of the lower end of anvil 33 downwardly along the frusto-conical flaring internal portion of the latter.

Figure 3:
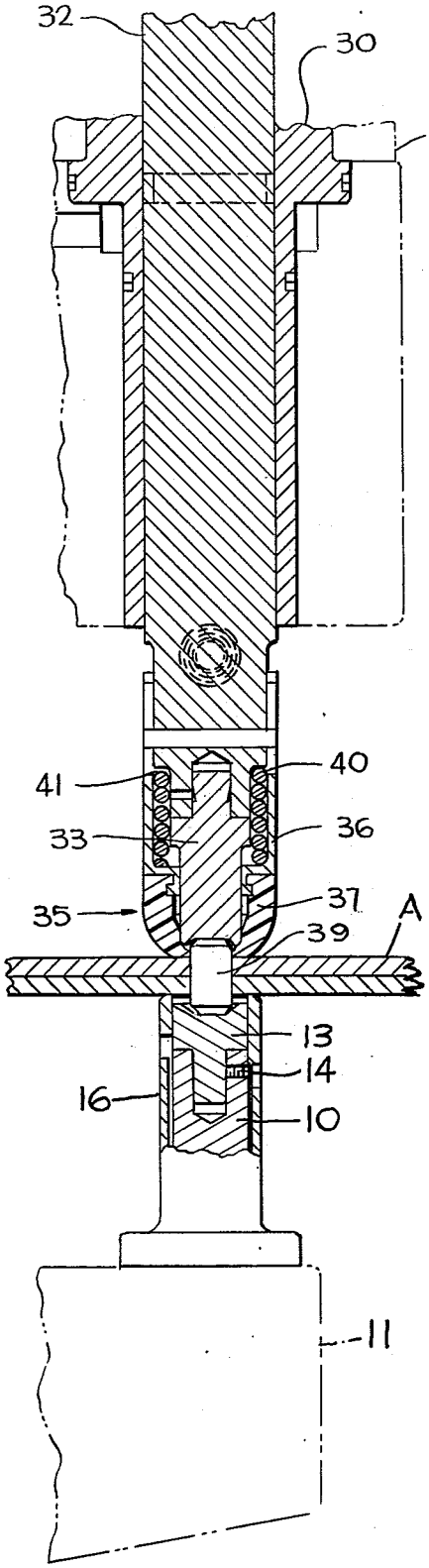
Figure 4:
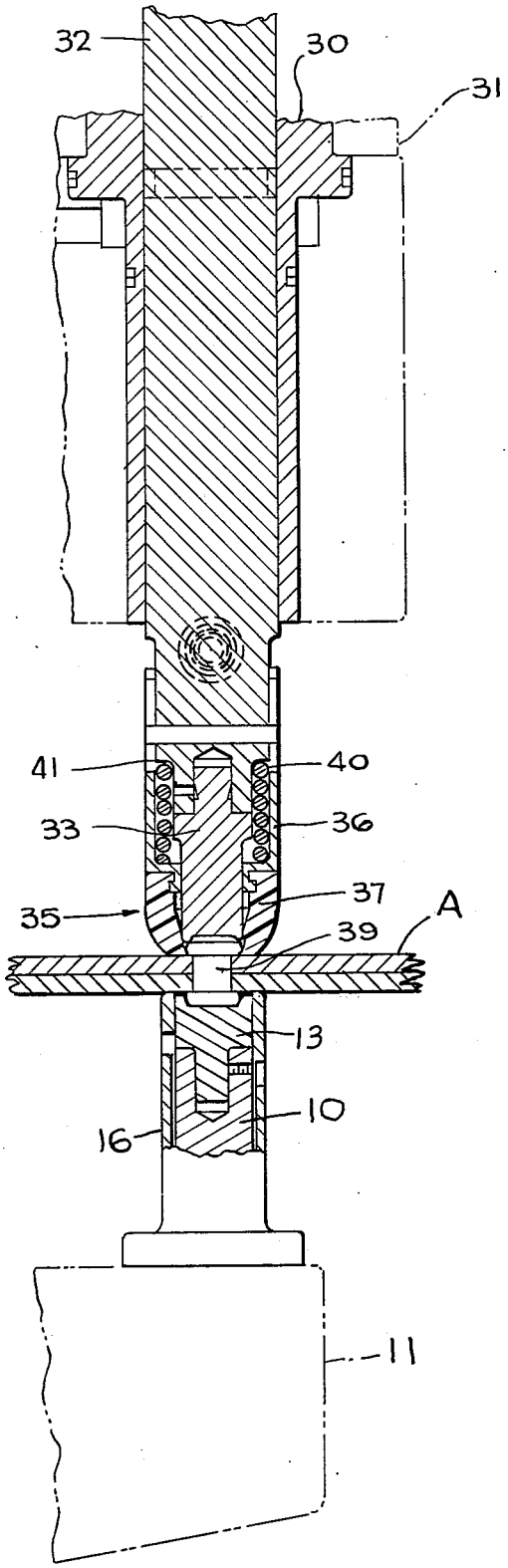

During this movement the rivet blank 39 bulges radially outwardly as will be seen from a comparison of FIGS. 2 and 3. Further downward movement of ram 32 and anvil 33 from the position of FIG. 3 to the position illustrated in FIG. 4 forms the heads at the opposite ends of rivet blank 39 and this continued downward movement of upper anvil 33 further distends elastomeric member 37 radially outwardly to the condition illustrated in FIG. 4. In movement of the parts from the position of FIG. 3 to the position of FIG. 4 the lower end of elastomeric member 37 is distended during formation of the upper rivet head but remains in closely embracing contact with such head. As this movement proceeds, the downward force of the parts due to the head formation which occurs at both ends of rivet blank 39 causes the clamp sleeve 16 of the lower pressure foot to move downwardly to a point where it is just slighly above the upper end of lower head forming anvil 13.

From the foregoing, it will be seen that the elastomeric member 37 securely grips the rivet blank 39 until the latter is fully inserted in the work, whereupon the operation of upper anvil 33 distends the elastomeric member 37, particularly the lower portion thereof, but this distension leaves the lower end of member 37 in closely embracing relation with the forming rivet head, as described above. The elastomeric retainer 37 is far simpler in construction and operation than prior art rivet blank positioning devices and is highly reliable in operation permits the rivet blank to be accurately positioned coaxially with respect to the head forming anvils.

The elastomeric member 37 serves the further useful purpose of supporting the rivet blank resiliently so that the blank may adjust its position in radial directions to correct for slight misalignments so that the opposite ends of the blank seat securely and accurately in the head forming recesses of the anvils 13 and 33 as previously described.

A preferred material for the annular elastomeric rivet blank holder 35 is polyurethane having a hardness of approximately 90 on the Shore A durometer scale. This hardness measurement may range between about 85 to 95 with generally satisfactory results. Other natural or synthetic materials having equivalent physical properties may, of course, be employed.

A preferred embodiment of this invention having been hereinabove described and illustrated in the drawings, it is to be understood that numerous modifications thereof can be made without departing from the broad spirit and scope of this invention as defined in the appended claims.

We claim:

1. Apparatus for inserting cylindrical rivet blanks in workpieces and forming rivet heads at opposite ends thereof comprising opposed rivet head forming anvils adapted to receive workpieces therebetween, at least one of said anvils being movable toward the other, an annular elastomeric rivet blank holder having a bore coaxial with respect to said anvils and adapted to fit over the end of one of said anvils and an outer portion having a bore of slightly less diameter than a rivet blank to receive and hold the same elastically therein, said last mentioned anvil being adapted to move axially relative to said blank holder upon relative movement of said anvils toward each other to expand the blank holder radially outwardly and move to a rivet blank into the workpieces and against the other of said anvils under pressure to form heads at the opposite ends thereof.

2. Apparatus according to claim 1 wherein said elastomeric rivet blank holder engages against the workpieces whereupon the anvil disposed therein moves axially with respect to said holder to expand the same.

3. Apparatus according to claim 1 wherein said two bores of said rivet blank holder are connected by an internal frusto-conical bore against which said last mentioned anvil acts to expand said elastomeric member.

4. Apparatus according to claim 1 wherein the anvil engaged with said elastomeric member moves toward the other anvil in a rivet inserting the head forming operation.

5. Apparatus according to claim 2 wherein said two bores of said rivet blank holder are connected by an internal frusto-conical bore against which said last mentioned anvil acts to expand said elastomeric member.

6. Apparatus according to claim 2 wherein the anvil engaged with said elastomeric member moves toward the other anvil in a rivet inserting and head forming operation.

7. Apparatus according to claim 1 wherein the elastomeric rivet blank holder comprises polyurethane.

8. Apparatus according to claim 1 wherein the elastomeric rivet blank holder has a hardness between 85 and 95 on the Shore A durometer scale.

9. Apparatus according to claim 1 wherein the elastomeric rivet blank holder comprises polyurethane having a hardness between 85 and 95 on the Shore A durometer scale.

* * * * *